US008202085B2

(12) United States Patent
Putrello

(10) Patent No.: US 8,202,085 B2
(45) Date of Patent: Jun. 19, 2012

(54) FIRE STARTER HAVING A POWER SOURCE

(76) Inventor: Andrew Putrello, Utica, NY (US)

( * ) Notice: Subject to any disclaimer, the term of this patent is extended or adjusted under 35 U.S.C. 154(b) by 620 days.

(21) Appl. No.: 12/070,741

(22) Filed: Feb. 22, 2008

(65) Prior Publication Data

US 2009/0214995 A1 Aug. 27, 2009

(51) Int. Cl.
*F23Q 1/02* (2006.01)

(52) U.S. Cl. ..... 431/273; 431/267; 431/269; 369/159; 369/253; 7/158

(58) Field of Classification Search ..... 431/273, 431/267, 269; 44/507; 369/159, 253; 429/115; 362/157, 159, 253; 7/158; 135/65
See application file for complete search history.

(56) References Cited

U.S. PATENT DOCUMENTS 1,920,347 A * 8/1933 Harry Blau ..... 451/316
2,116,448 A * 5/1938 O'Bren et al. ..... 324/556
2,443,123 A * 6/1948 Solon ..... 431/273
3,278,009 A * 10/1966 Crump, Jr ..... 206/121
4,698,068 A * 10/1987 Jensen ..... 44/507
4,752,544 A * 6/1988 Gregory ..... 429/188
5,279,628 A * 1/1994 Hutchens et al. ..... 44/507
5,919,037 A * 7/1999 Brillhart et al. ..... 431/273

* cited by examiner

*Primary Examiner* — Steven B McAllister
*Assistant Examiner* — Avinash Savani
(74) *Attorney, Agent, or Firm* — Hiscock & Barclay, LLP; R. S. Rosenholm

(57) ABSTRACT

The present invention presents a power generating spark emitting apparatus in which a mischmetal flint rod also operates as a electron generating source. Either the handle material itself or an internal cathode operates in conjunction with the mischmetal flint rod to form a power source. The cathode and anode are connected across a light emitting diode or incandescent lamp to provide an illumination device. A strike plate mounted within a guided angled recess is disposed on a housing to present the mischmetal flint rod with a strike source such dragging the mischmetal flint rod across the strike plate release sparks from the mischmetal flint rod sufficient to ignite a tinder bundle.

28 Claims, 15 Drawing Sheets

100

FIRE STARTER HAVING A POWER SOURCE

FIELD OF THE INVENTION

The present invention relates generally to the field of outdoor enthusiast gear and, more particularly, to a spark emitting device having an electronic potential capable of providing enough power to illuminate a light emitting diode or a small incandescent lamp.

BACKGROUND OF THE PRESENT INVENTION

In the field of outdoor enthusiast equipment, there are many different types of necessary equipment including knives, spark emitting devices, matches, lighters, flashlights, etc. The usefulness of these devices are obvious.

Typically the outdoor enthusiast carries matches or a lighter in which to start a fire. The enthusiast gathers different sized bundles of wood and a small amount of minute kindling matter. The kindling matter is generally bundled up and ignited. Gradually larger and larger pieces of wood are added to generate a fire.

One problem that often occurs is that the matches or lighter become wet and unusable since many outdoor enthusiast activities are planned about water borne structure such as lakes, rivers and the like. It is not uncommon to fall into such a structure while carrying the matches or the lighter thus rendering the same unusable. Still further, it oftentimes rains during such activities which invariably presents the same water destruction to the matches and lighter. Windy conditions also present match and lighter users problems of maintaining a flame after ignition.

One way to ensure that there is always access to a fire is to carry a spark emitting device such as a flint or other spark emitting device. The flint or spark emitting material is struck by a hard object and sparks are release which ignite the kindling matter. Thus, even if the flint or other spark emitting device becomes wet, it will still emit sparks sufficient to ignite kindling matter.

Another piece of outdoor equipment that is often used is a flashlight. However, flashlights are often bulky to carry and must be transported in a knapsack or other carrying device. Water again presents a problem to flashlights in that the battery case is often not completely watertight. Thus, water often enters the battery case and renders the electrodes inoperable.

A further problem with flashlights are that the batteries that are used to power the bulb do not have a long life. It is not uncommon for a flashlight to become unusable in the middle of an outdoor excursion due to the batteries becoming dead.

SUMMARY AND OBJECTS OF THE PRESENT INVENTION

It is an object of the present invention to improve the art of outdoor enthusiasm.

It is another object of the present invention to make fire starting more reliable to the outdoor enthusiast.

It is a further object of the present invention to provide a light emitting device that is more reliable than the prior art.

It is yet another object of the present invention to provide a light emitting device that is easily carried in a pocket and does not require portable batteries for power.

It is still another object of the present invention to provide a light emitting device and a fire starting device in a single piece of equipment.

It is a feature of the present invention to provide a light emitting device, a fire starting device and additional outdoor gear in a single piece of equipment that is conveniently carried in a pocket of one's clothing without causing damage.

These and other objects and features are provided in accordance with the present invention in which a power generating spark emitting device includes a handle having an axially directed cavity disposed therein. A portion of the handle has a fixed standard reduction potential that is more positive than the fixed standard reduction potential of the mischmetal flint rod thereby presenting a cathode. In one embodiment the cathode handle is comprised of a some combination of elements selected to allow the handle to always have a fixed standard reduction potential more positive than the material used to manufacture the spark emitting rod.

The mischmetal flint rod or any material used to cause a spark has a fixed standard reduction potential which is more negative than the fixed standard reduction potential of the cathode and thus becomes the electron donor. An electrolyte disposed within the axially directed cavity of the handle interconnects the mischmetal flint rod and the cathode.

A first terminal is electronically coupled to the mischmetal flint rod while a second terminal is electronically coupled to the cathode. An illumination member, preferably an LED or a small incandescent lamp, is electronically coupled across the first and second terminals. A switch interrupts the first and second terminal to control illumination.

A housing which includes an internal cavity mates with the handle such that the protruding portion of the flint rod is disposed within the internal cavity of the housing when sparks are not needed.

The housing further includes a strike plate affixed thereto. The strike plate sits within a recess to prevent clothing from being torn when carrying the device. A recess guide is angled with respect to the strike plate to present a guide for a proper striking angle to optimize spark production, also provides lateral support when striking.

Additional features of the device include a storage housing which mates with the handle for storing extraneous equipment. Further, the mischmetal flint rod may include a tool end to present the user with added survival ability.

BRIEF DESCRIPTION OF THE DRAWINGS

The present invention will be understood and appreciated more fully from the following detailed description taken in conjunction with the drawings in which.

DETAILED DESCRIPTION OF THE PRESENT INVENTION

Figure 1:
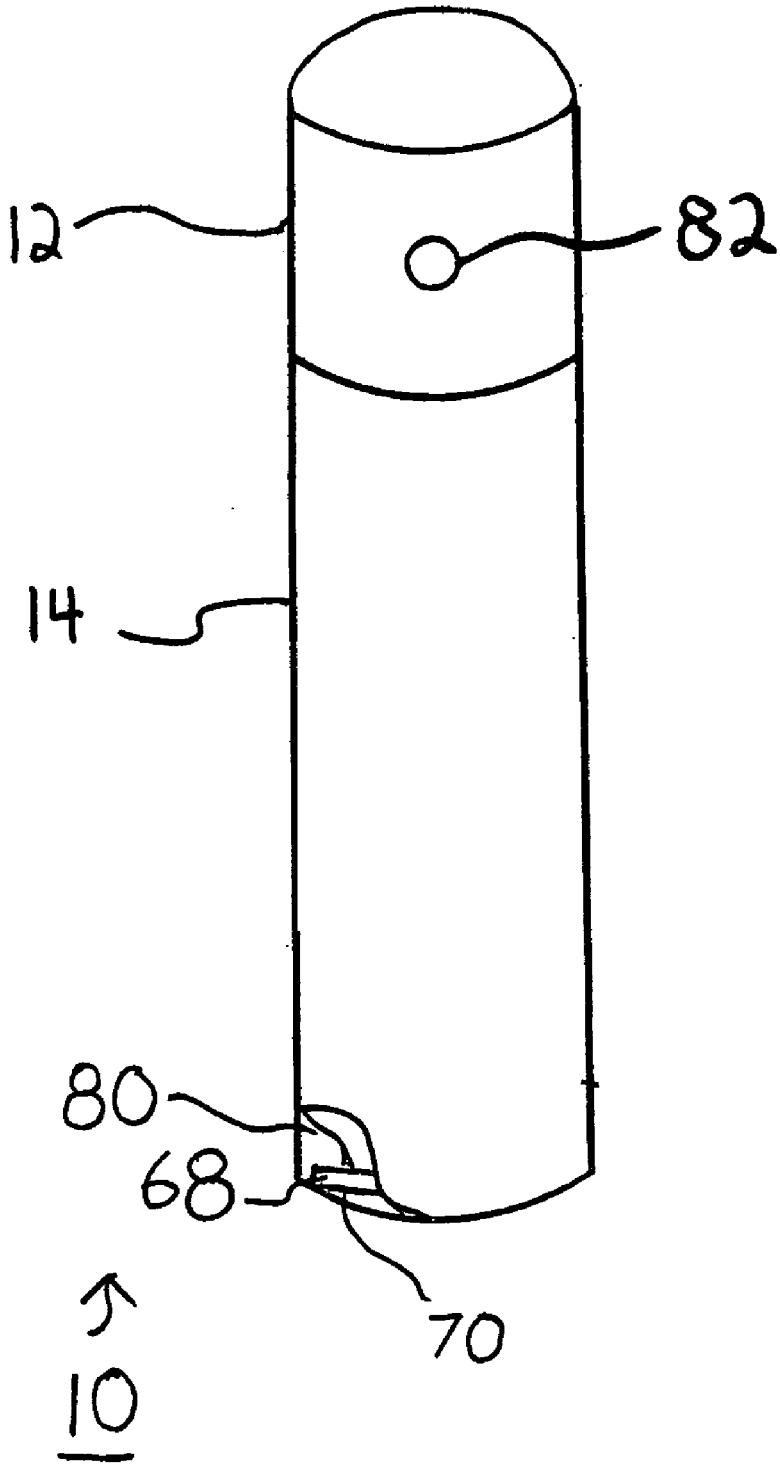
FIG. 1 is front elevation view of a preferred embodiment of a power generating spark emitting device of the present invention in a closed position.
Figure 2:
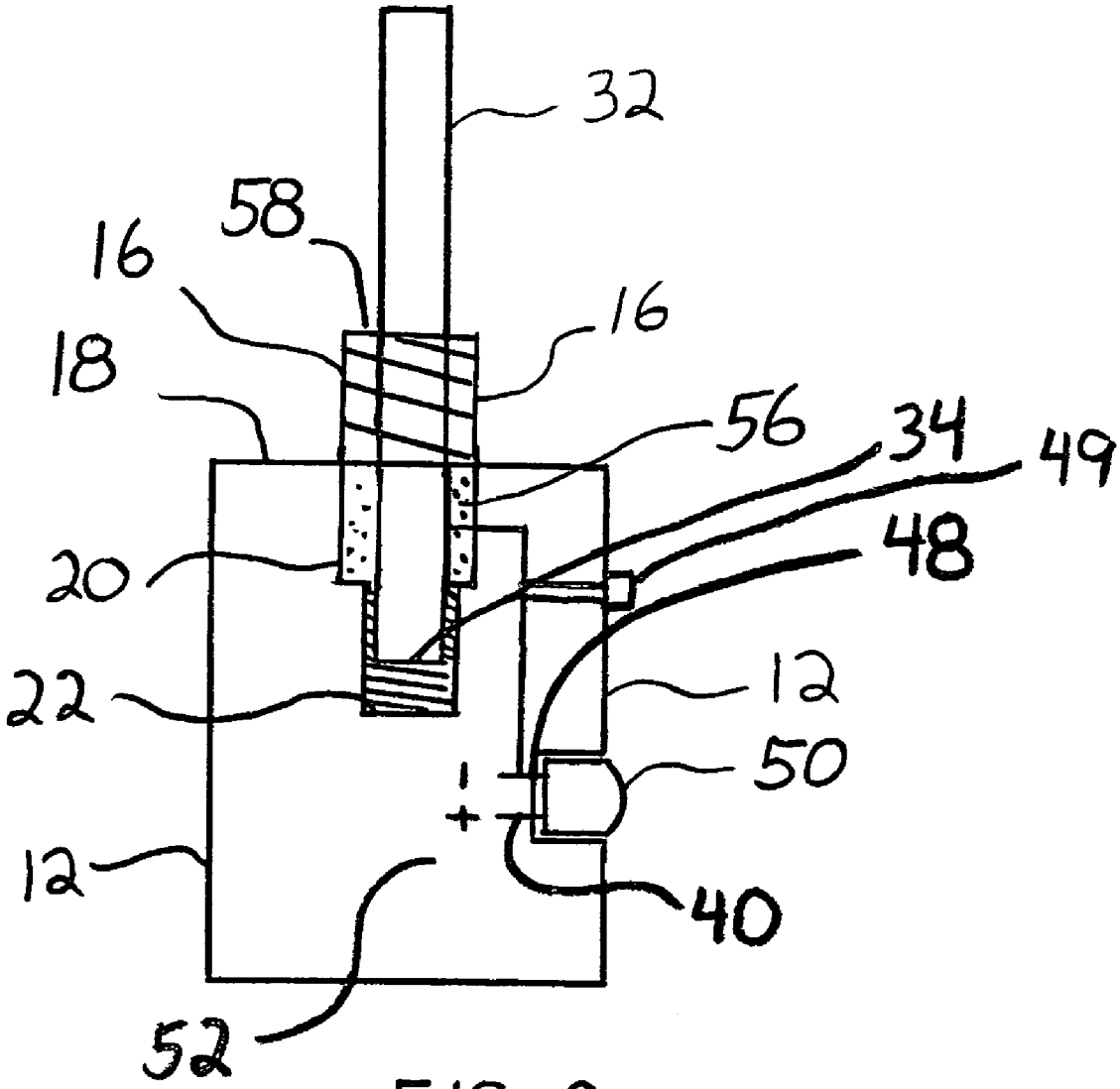
FIG. 2 is a cross-sectional view of a preferred embodiment of a power generation handle of the present invention.

Turning now to FIGS. 1 and 2, a power generating spark emitting device 10 of the present invention includes a power generation handle 12 and a housing 14. The power generation handle 12 is a one piece injection molded metallic, or other suitable material, cylindrical structure having a threaded member 16 protruding from a leading edge 18. A handle opening 20 is axially bored through the threaded member 16 and a portion 22 of the power generation handle 12. Alternatively, the handle opening 20 may be created during the molding process. It is not necessary that the power generation handle 12 or any part thereof be cylindrically shaped as other shapes, such as rectilinear, may work just as well.

Figure 3:
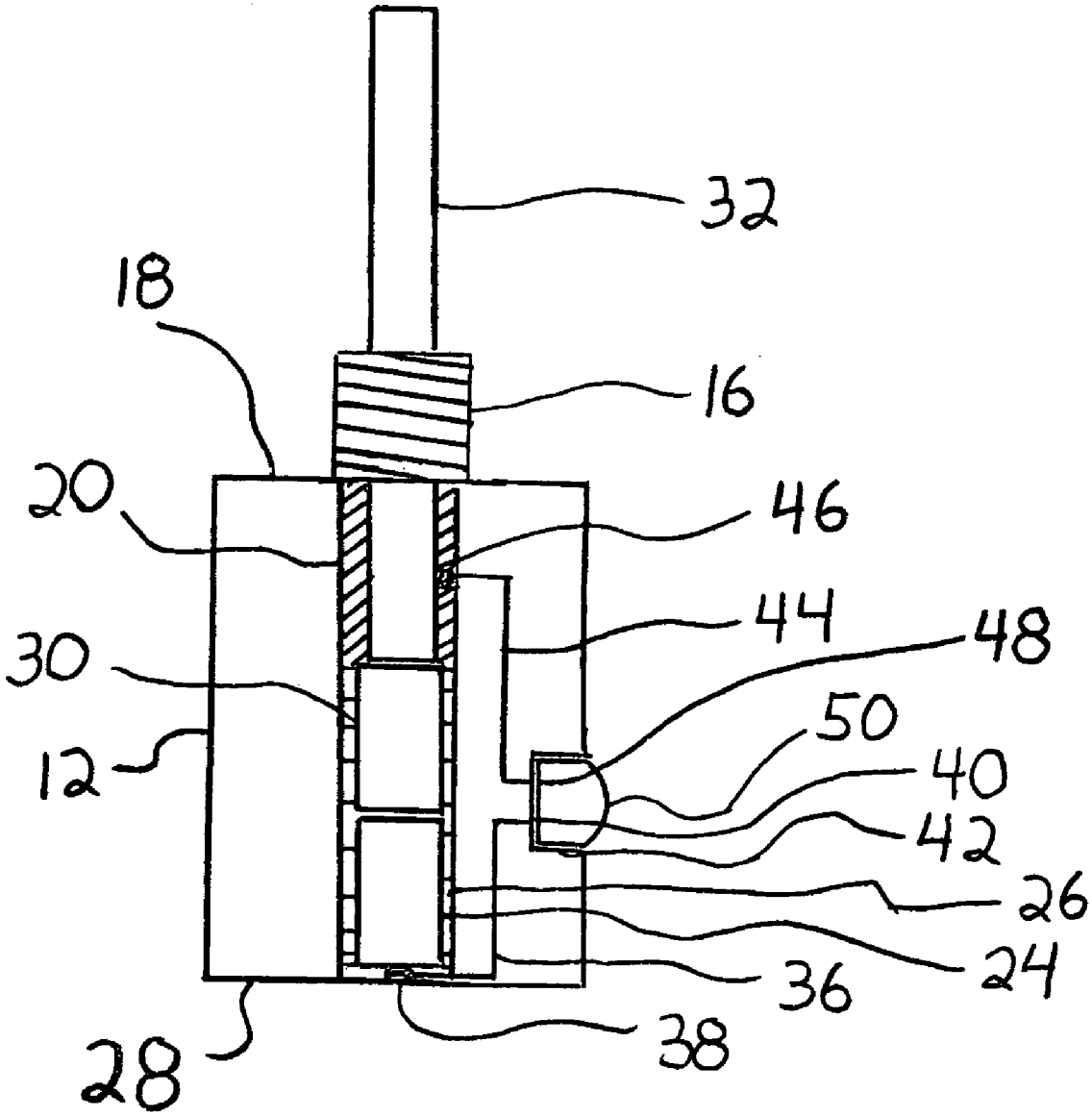
FIG. 3 is a cross-sectional view of another preferred embodiment of the power generation handle of the present invention.

In an embodiment depicted in FIG. 3, a cylindrical copper member 24 having an insulating radial jacket 26 is inserted through the handle opening 20 towards the rearward edge 28 of the power generation handle 12. The insulating radial jacket 26 may be an epoxy or other substance which prevents the flow or electricity while maintaining the copper member 24 in place within the handle opening 20.

Alternatively a radial insulating jacket having an opening disposed therethrough may be inserted into the handle opening 20 to receive the copper member 24.

An electrolyte 30, such as a cotton material soaked in lithium perchlorate in a suitable solvent such as propylene carbonate, is inserted into the handle opening 20 to the cylindrical copper member 24. Again, the electrolyte 30 is also inserted into the insulating radial jacket 26 or includes its own insulating radial jacket to prevent the flow of electricity to the power generation handle 12.

Next, a mischmetal flint rod 32 is secured into the handle opening 20 by an epoxy 56, shown in FIG. 2, so that an inserted end 34 of the mischmetal rod 32 contacts the electrolyte 30. The mischmetal flint rod 32 has a standard reduction potential that is more negative than the standard reduction potential of the copper member 24. As such an electrical potential difference exists between the copper member 24 and the mischmetal flint rod 32. The copper member 24 acts as a positive charged cathode while the mischmetal flint rod 32 acts as a negative charged anode.

A positive lead 36 is soldered to a contact 38 on the copper member 24 and is insulated from the handle 12 using a rubber gasket when the handle 12 is of metallic composition. The positive lead extends from the copper member 24 to a light emitting diode ("LED") or incandescent lamp positive charged terminal 40 in an LED cavity 42. The contact 38 has the same standard reduction potential as the copper member 24.

A negative lead 44 extends from a small screw 46 which is threaded into the mischmetal flint rod 32 and insulated from the handle 12. The negative lead 44 extends to a LED or small incandescent lamp negative charged terminal 48 in the LED cavity 42.

An LED 50 or an incandescent lamp is installed into the LED cavity 42 so that it contacts the positive and negative terminals 40, 48 thereby illuminating the LED 50. Since the entire charge is provided by the difference in the standard reduction potential of the dissimilar metals that the device itself is made of, there is no need for any batteries and there will always be a charge present across the terminals 40, 48 so long as the electrolyte 30 remains conductive so long as there is fire starting rod material available to supply electrons. Because the fire starting rod is solid and several inches in length it contains more electron donating material than would be able to be inserted into a battery that would otherwise power the LED 50 without the necessity of having a device impractibly large.

A small microswitch 49, depicted in FIG. 2, is mounted on the handle to turn light on and off.

Turning back to FIG. 2, there is depicted a variation of providing power to the LED terminals 40, 48. In this case, the power generation handle 12 itself is a positive charged cathode 52 while the mischmetal flint rod 32 is a negative charged anode. The mischmetal flint rod 32 is once again epoxied into the handle opening 20. This time, the epoxy 56 is a material so that it also acts as an electrolyte to allow the continuous flow of electrons from the anode mischmetal flint rod 32 to the cathode 52.

An electrolyte such as that described with reference to FIG. 3 may also be used in this variation and can be inserted between the end of the mischmetal rod and the handle itself with an insulating radial jacket as described in FIG. 3.

Figure 4:
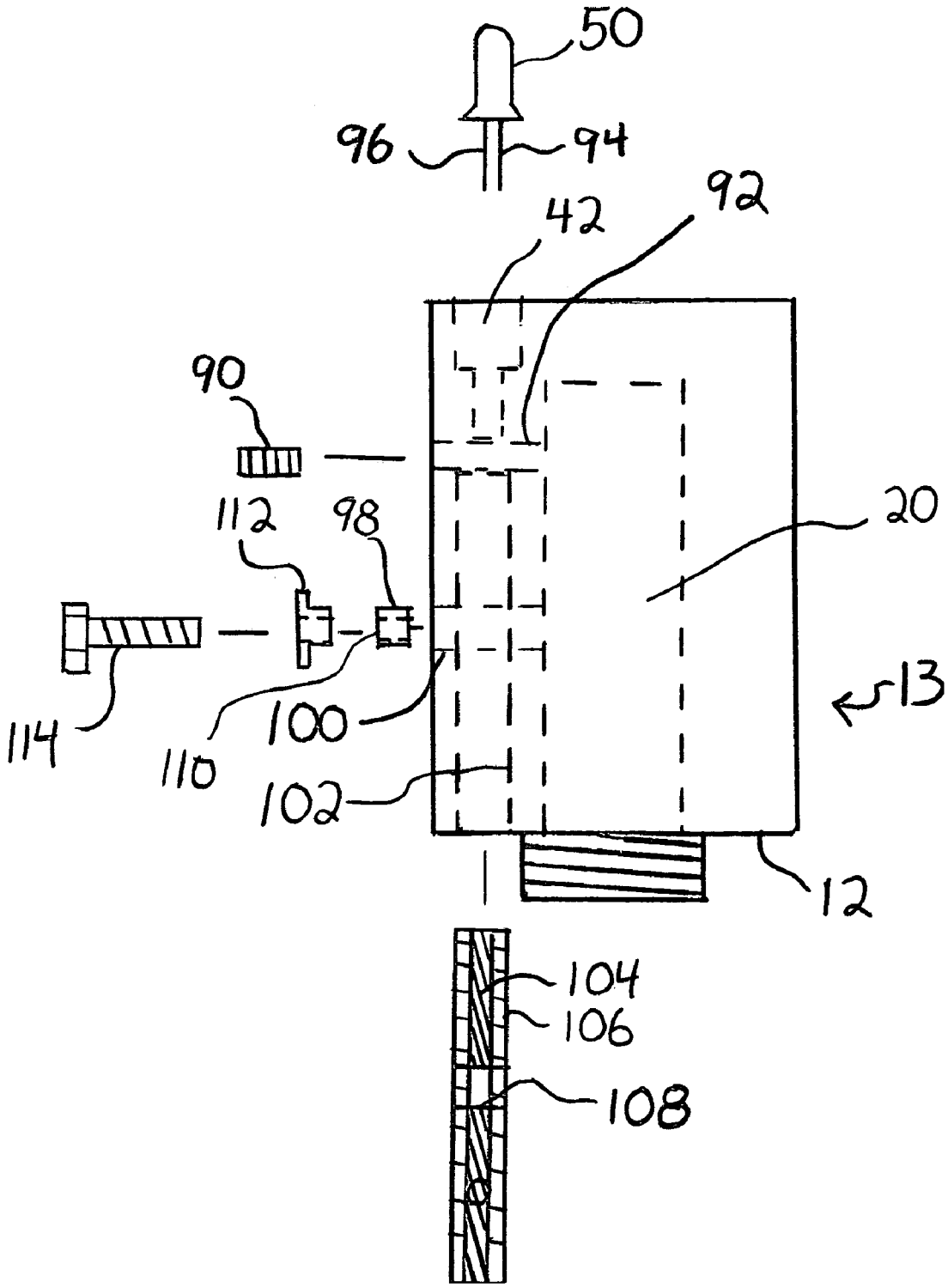
FIG. 4 is a cross-sectional exploded view of a shell of yet another preferred embodiment of a power generation handle of the present invention.
Figure 5:
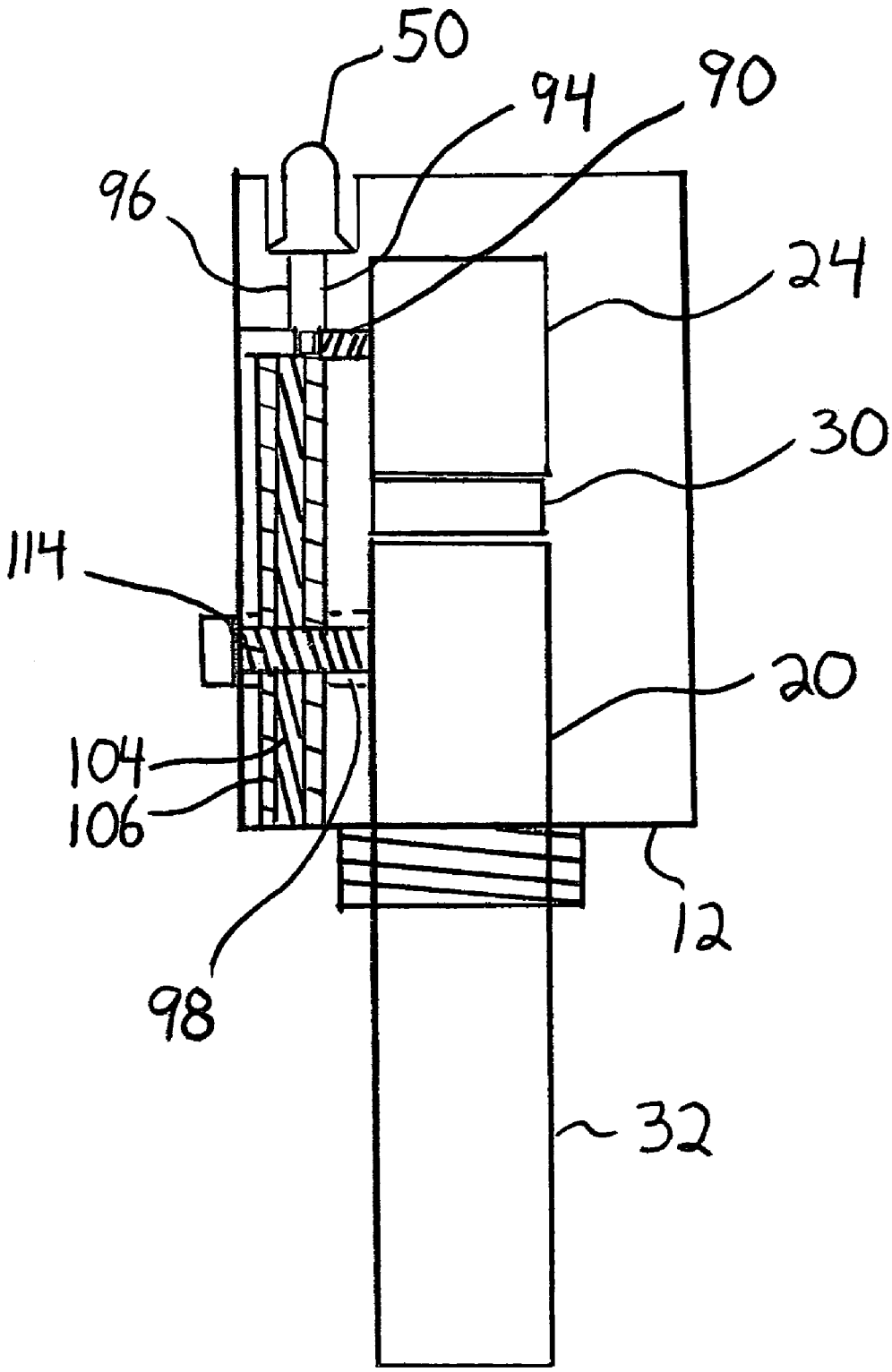
FIG. 5 is a cross-sectional view of the power generation handle having the shell of FIG. 4.

Looking at FIGS. 4 and 5, there is depicted a preferred embodiment of fabricating a power generating spark emitting device 10, depicted in FIG. 1, of the present invention. A power generation handle shell 13 is manufactured by either one piece injection molding or by machining a single power generation handle 13 and boring necessary cavities to insert and secure various components, which is depicted in the exploded view of FIG. 4.

In FIG. 5, the cylindrical copper member 24 is inserted into the handle opening 20. Then the electrolyte 30 is installed to an open end of the copper member 24. Finally the mischmetal flint rod 32 is installed as described herein, such as with an epoxy or radial insulating jacket.

Next, an internal screw 90 is installed into an female threaded opening 92 so that it contacts the copper member 24, thus creating electrical connectivity there between. Where the housing is metal, the female threaded opening 92 is insulated. Where the housing is non-metallic then the female threaded opening 92 is not insulated. The LED 50 is installed into am LED cavity 42 so that a first lead 94 contacts the internal screw 90, while a second lead 96 extends to the opposite side of the opening 92.

In order to provide a switching mechanism, a first non-conductive bushing 98 is fitted into a switch opening 100 so that it completely lies beneath a conductor slot 102. Next, a conductor 104 fitted within an annular non-metallic sleeve 106 is inserted into the conductor opening 102 so that the inserted end of the conductor 104 contacts the second lead 96 of the LED 50.

Various methods and material compositions may be employed by one skilled in the art to accomplish the various components of the present invention.

The non-metallic sleeve 106 prevents the conductor 104 from contacting the power generation handle shell 13, which is desirable if the power generation handle shell 13 is of a metallic composition. The non-metallic sleeve 106 and conductor 104 include a threaded opening 108 therethrough which axially aligns with an opening 110 in the bushing 98.

Next, an upper bushing 112 is installed into the switch opening 100 so that it contacts the non-metallic sleeve 106. A switch screw 114 is installed through the threaded opening 108 of the conductor 104 and into switch opening 100 thereby creating an electrical contact there between.

When the switch screw 114 is completely inserted, it contacts the mischmetal flint rod 32 thereby creating an electrical flow. The electrical potential difference between the mischmetal flint rod 32 and the cylindrical copper member 24 is now directed across the LED leads 94, 96 thereby illuminating the LED 50 or small incandescent lamp.

To shut the LED 50, the switch screw 114 is slightly loosened so that it no longer contacts the mischmetal flint rod 32.

The mischmetal flint rod 32 is composed of a combination of a number of metal which includes iron, magnesium, cerium, lanthanum, neodymium, praseodymium and may include combinations of other metals as well.

As depicted in FIG. 2, the mischmetal rod 32 protrudes from a forward edge 58 of the threaded member 16. When the protruding mischmetal flint rod 32 is struck against a hard surface, it yields sparks sufficient to ignite a tinder bundle.

Also depicted in FIG. 2, is a microswitch 49 which can be implemented in any version of the present invention to control the power to the LED 50.

Figure 6:
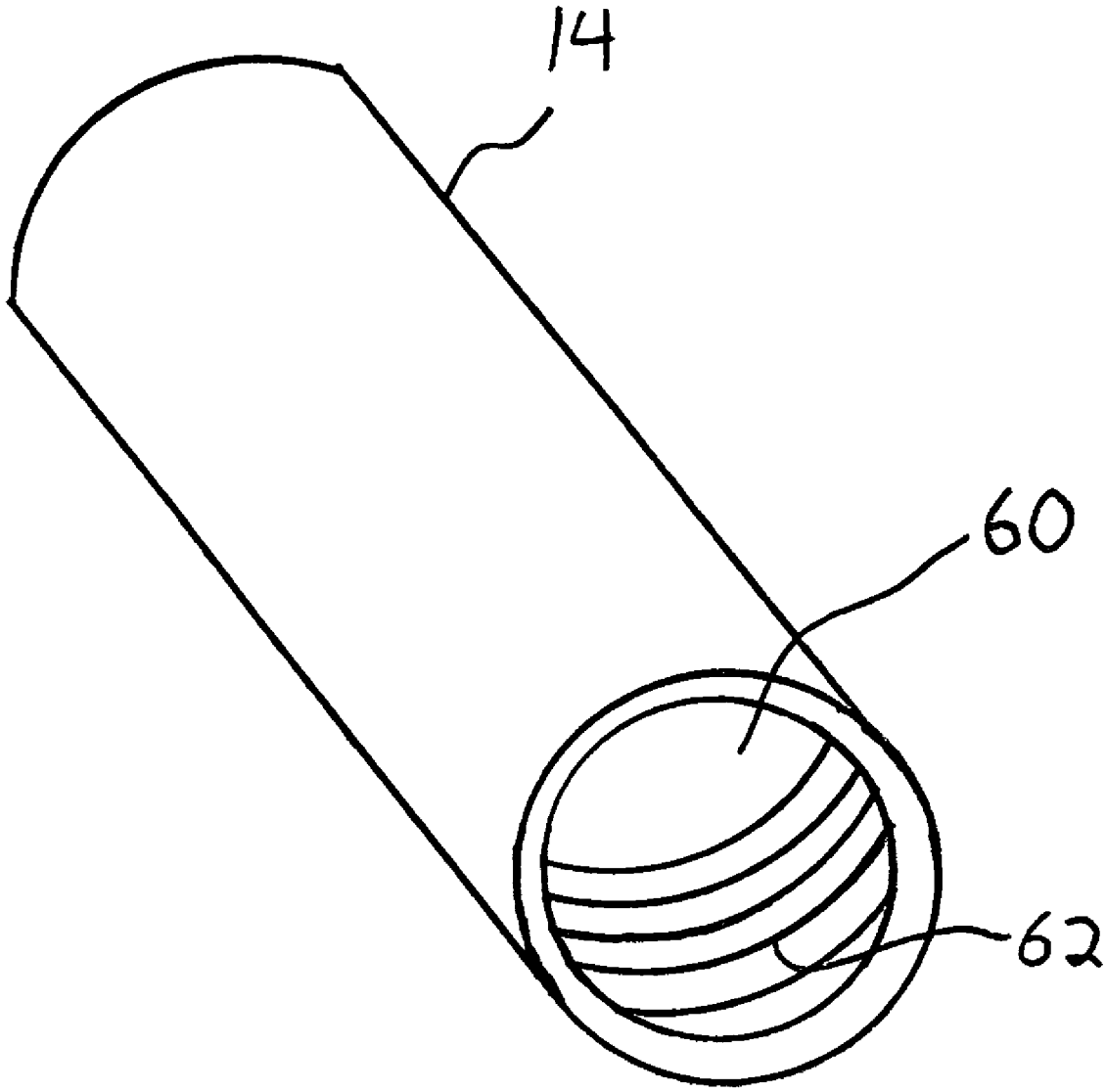
FIG. 6 is a bottom elevation view of a housing of the power generating spark emitting device of FIG. 1.
Figure 7:
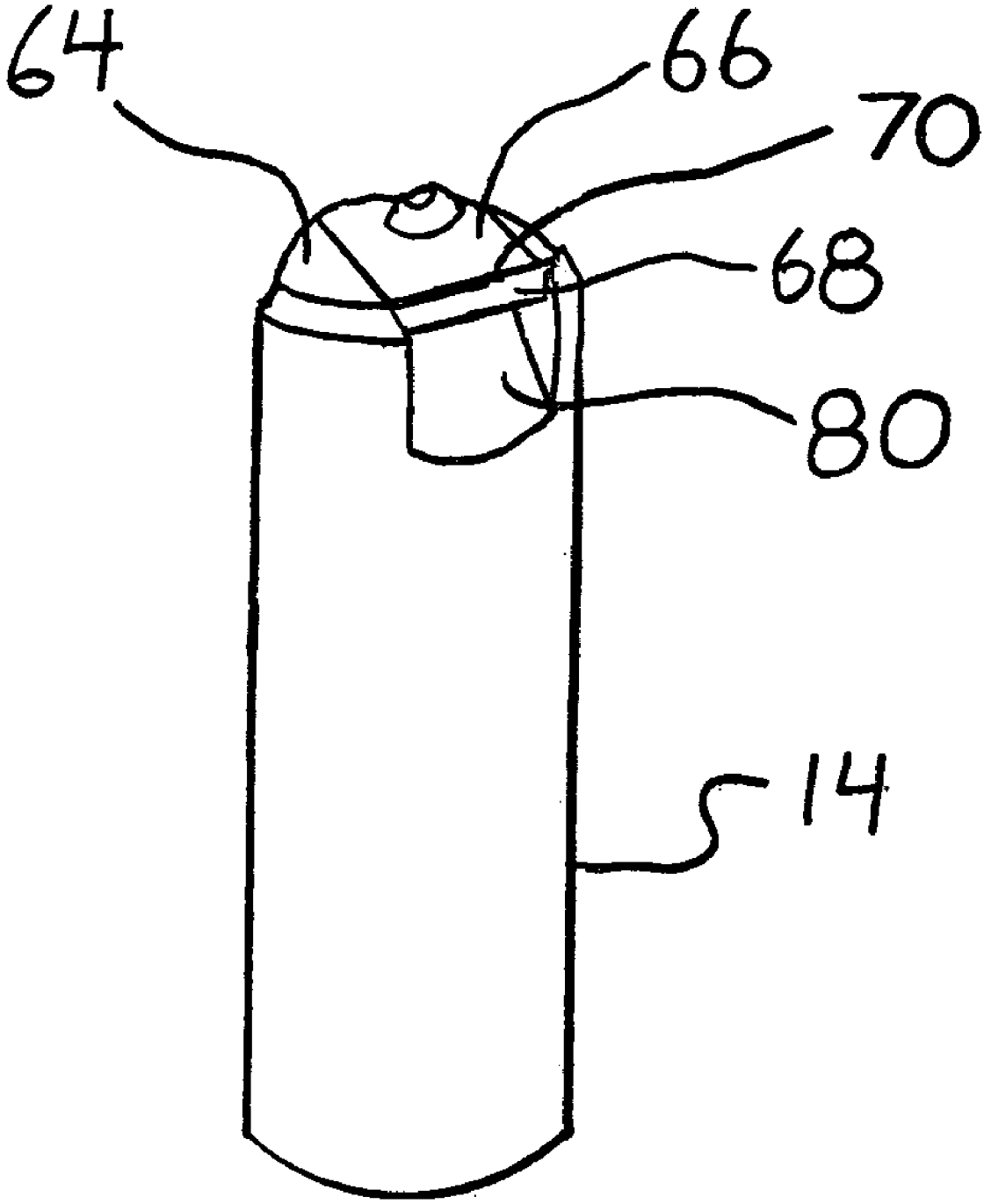
FIG. 7 is top elevation view of the housing of FIG. 6.

Still referring to FIG. 1 and also to FIGS. 3, 6 and 7, a cylindrical shaped housing 14 is bored a substantial distance to create a storage cavity 60 for storing the mischmetal flint rod 32 when not in use so that a person does not become impaled or otherwise injured from the protruding mischmetal flint rod 32.

Referring to FIG. 6, inner bored threads 62 mate with the threaded member 16 of the power generation handle 12 to present a secure power generation spark emitting device 10 as depicted in FIG. 1. It should be apparent to one skilled in the art that other methods may be used to secure the power generation handle 12 to the housing 14, such as pins and grooves (not depicted) or other methods.

Looking now at FIG. 7, at a closed end 64 of the housing 14 a metallic tab 66 is joined, within an angled recess 80, such as by riveting, screwing, welding, or during the molding process. The metallic tab 66 has a pair of opposing flat edges 68 which will be referred to also as strike plates. The strike plate 68 is recessed to prevent damage to clothing pockets when carried.

Figure 15:
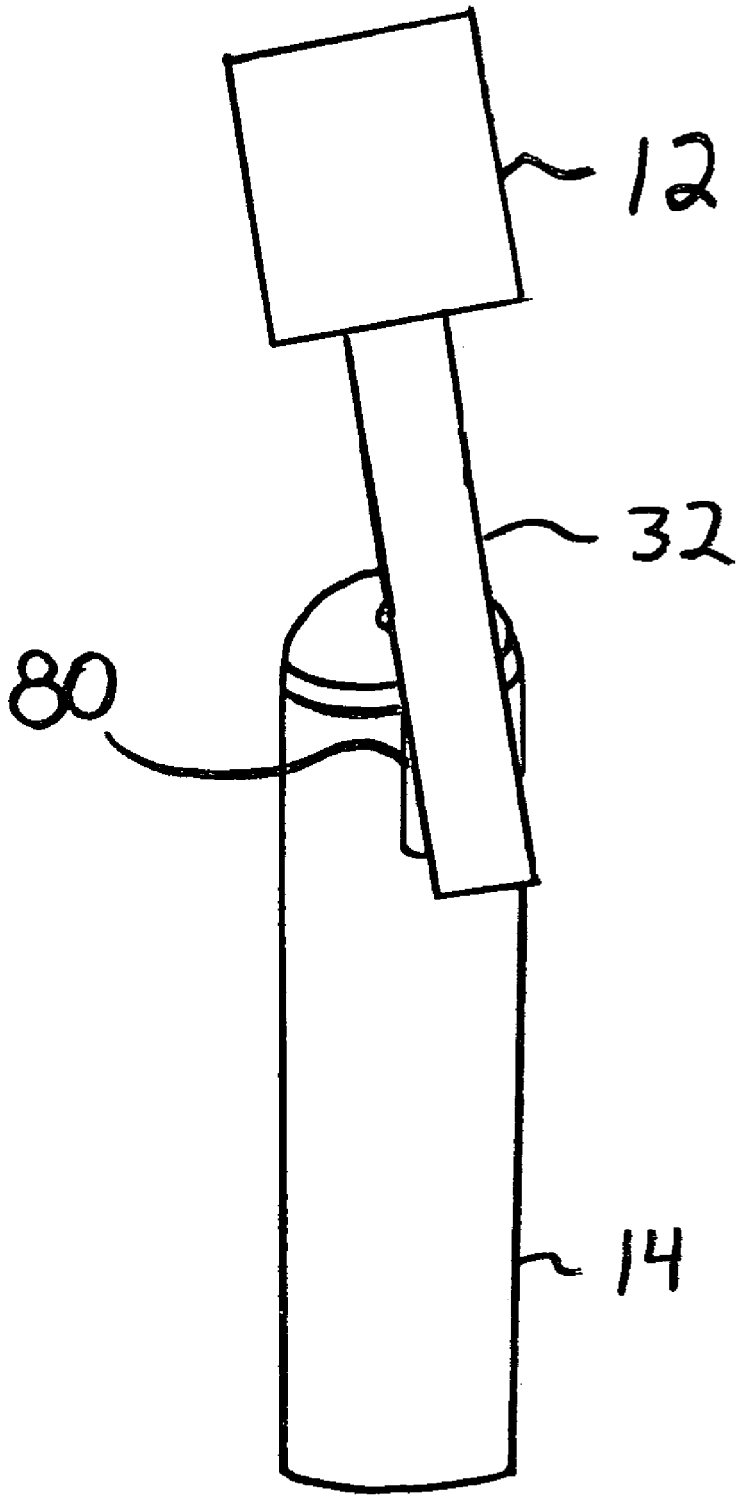
FIG. 15 is an elevational view of the power generating spark emitting device of FIG. 1 in an open and spark emitting position.

Referring to FIG. 15 there is shown how to produce sparks in accordance with the present invention. The protruding mischmetal flint rod 32 is guided against a top edge 70 of one of the strike plates 68 at the optimal forty five degree angle and dragged quickly across the top edge 70 at the same angle, thus releasing a plurality of sparks sufficient to ignite the tinder bundle. Dragging across only the top edge 70 provides the maximum force per contact area, which maximizes the release of sparks.

A base recess 80 also presents a forty five degree angle with respect to the strike plate, whereby the base recess 80 acts as both a visual and mechanical guide with lateral support to optimize the striking angle. This allows the device to used in complete darkness because once the mischmetal flint rod 32 is placed into the recess 80, the recess 80 acts keeps the blade in place at the optimum angle with lateral support, depicted in FIG. 15.

Figure 8:
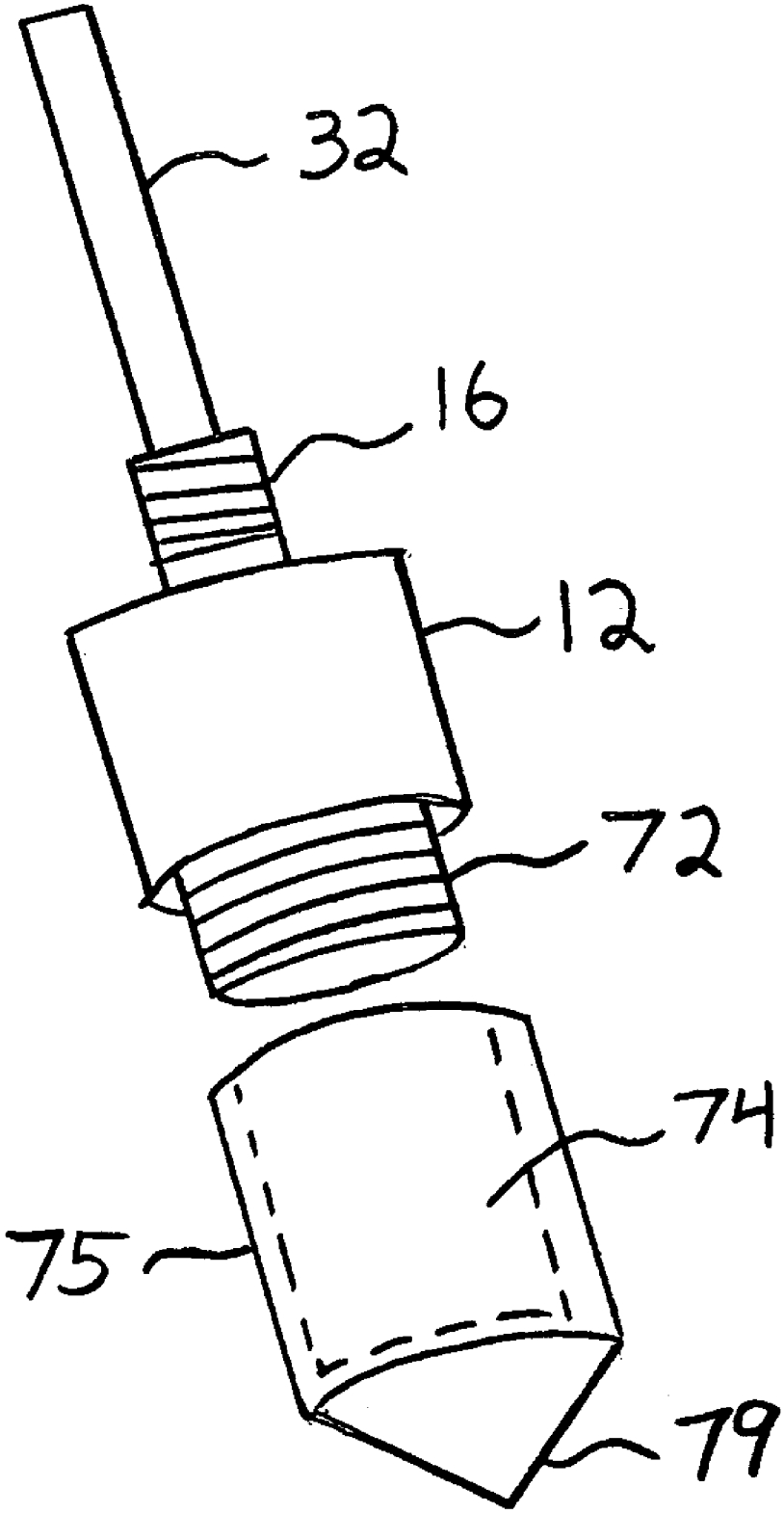
FIG. 8 is a side elevation view of the power generation handle of FIG. 2 further including a storage cavity that further includes an optional attachment.

Turning now to FIG. 8 either the power generation handle or the housing may include a choice of separately threaded member 75 which mates thereto to produce a storage cavity 74 sufficient to store fishing hooks, water purification tablets or other small survival gear. The separately threaded member 75 may also include a window breaker 79 for certain emergency uses. Additionally, a compass (not depicted) may be mounted to either the handle 12 or the housing 14.

In yet another embodiment depicted in FIGS. 11-14, both the power generation handle 12 and the housing 14 operate together to provide a power source and switch to power the LED 50. Turning first to the power generation handle 12, an annular member 100 having a copper or other conductive insert 102 is affixed to a leading edge 122 of the power generation handle 12, depicted in FIGS. 13 and 14. The annular member 100 has a notched edge 104 which provide for direct access to the conductive insert 102.

The power generation handle 12 includes a notched portion 124 along its exterior surface 126. A u-shaped insulator 128 is fitted within the notched portion 124. A conductive strip 130 having a bent tip 106 is inserted within the u-shaped insulator 128 such that it is separated from the rest of the power generation handle 12. The bent tip 106 though contacts the conductive insert 102 through the notched edge 104.

When the power generating spark emitting device 10, depicted in FIG. 1, is closed the mischmetal flint rod fits within the housing 14.

Figure 11:
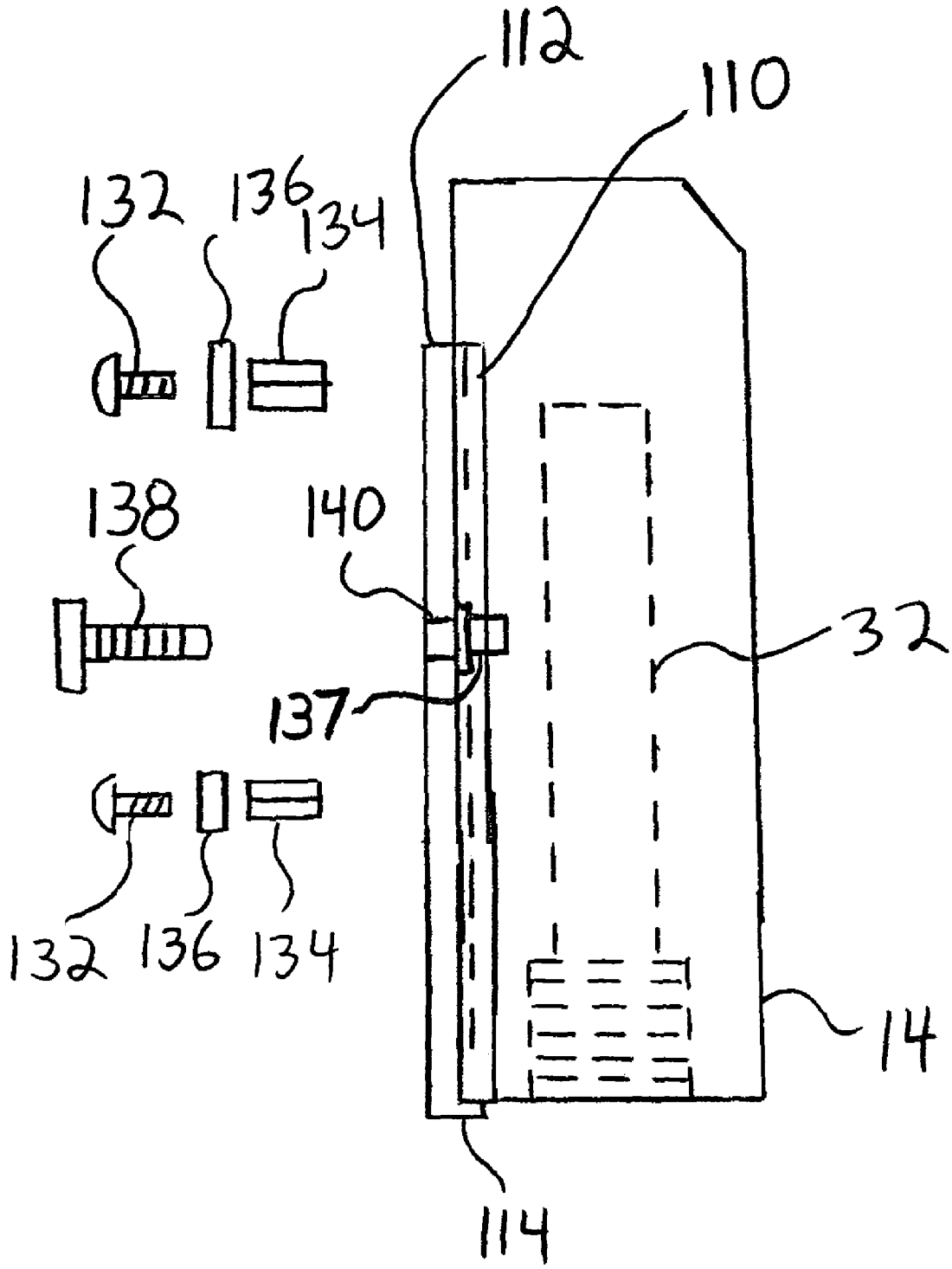
FIG. 11 is a cross sectional view of a housing in accordance with still another preferred embodiment of the present invention.
Figure 12:
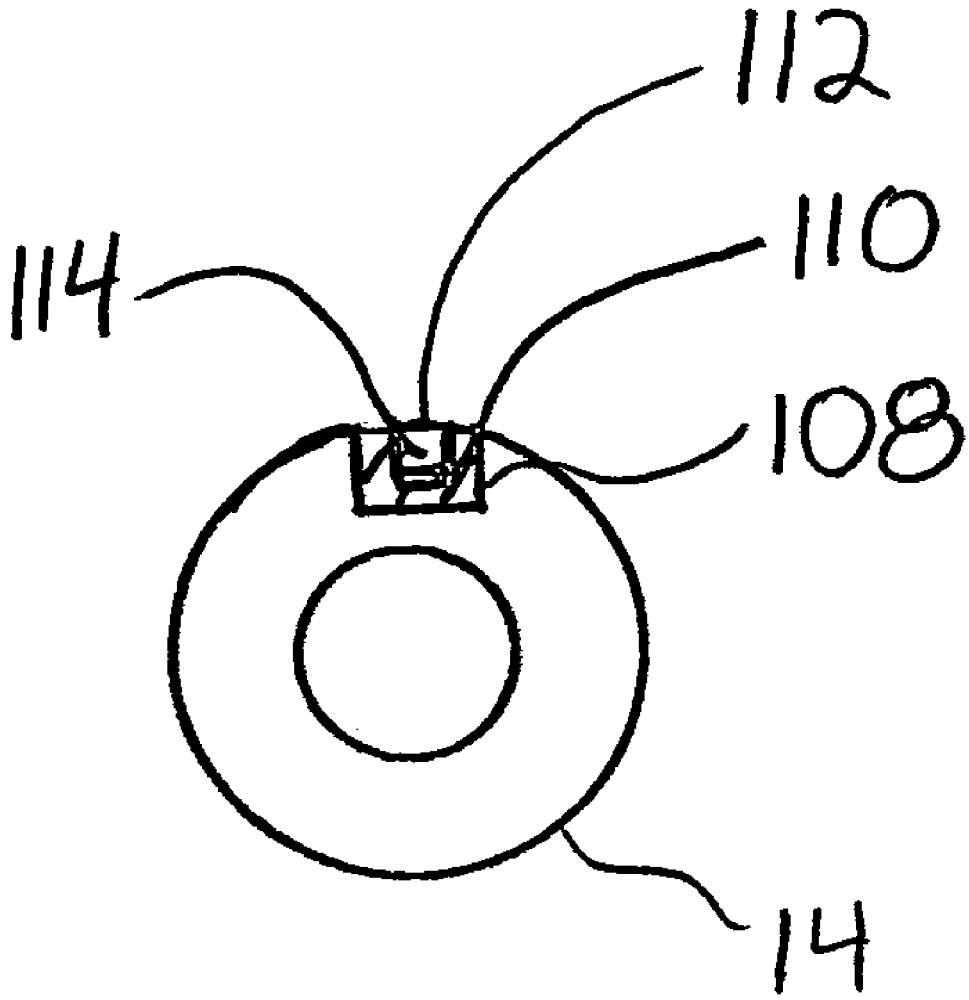
FIG. 12 is an axial view of the housing of FIG. 11.
Figure 13:
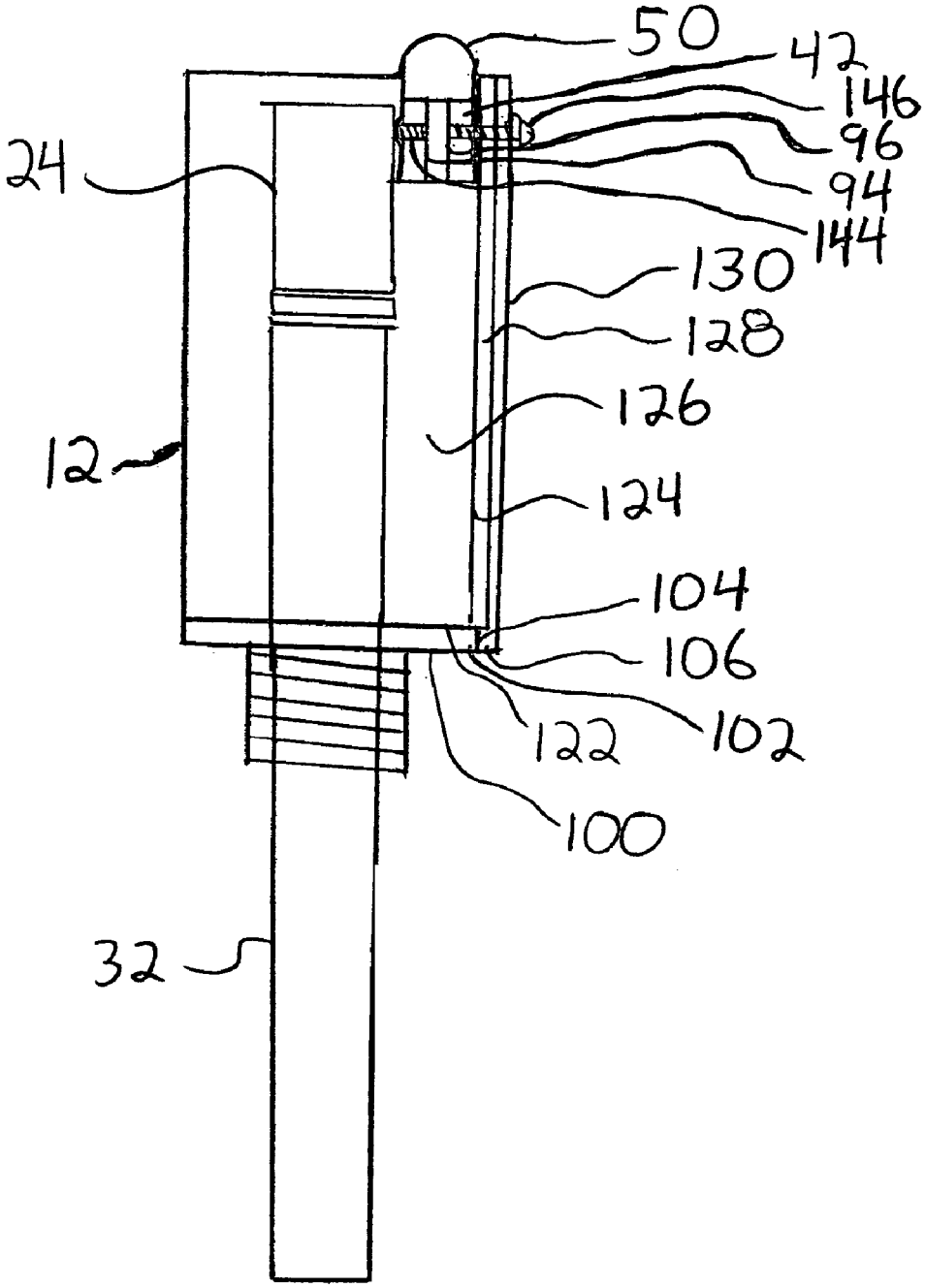
FIG. 13 is a cross sectional view of the power generating handle which couples with the housing of FIG. 11.
Figure 14:
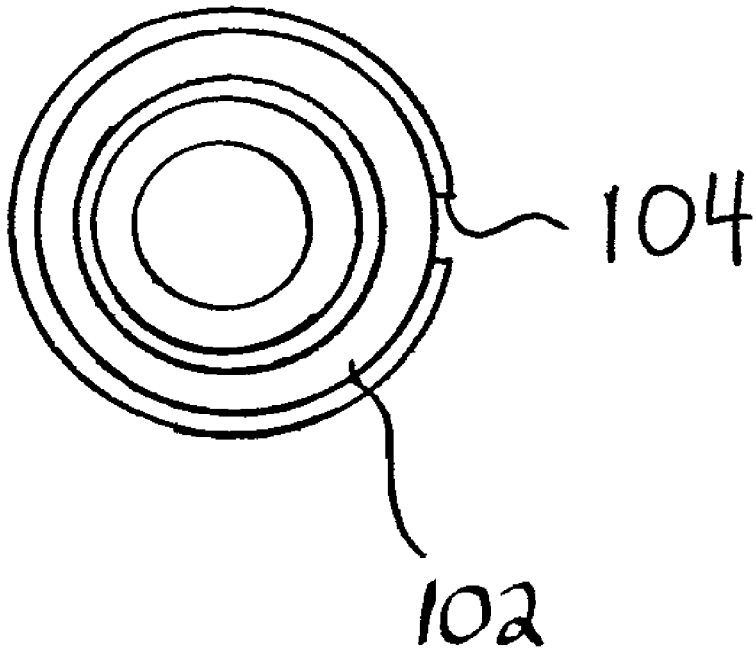
FIG. 14 is an axial view of an annular member which provides conductivity between the housing of FIG. 11 and the power generating handle of FIG. 13.

Turning to FIGS. 11, 12 and 13, the housing 14 has a notched portion 108 along its exterior surface. Once again, a u-shaped insulator 110 is fitted within this notched portion 108. A conductive strip 112 fits within the u-shaped insulator 108 and includes a bent tip 114 which contacts the conductive insert 102 when the housing 14 and power generation handle 12 are closed. As a result the conductive insert 102 acts as a conductor between the conductive strip 130 of the power generating handle 12 and the conductive strip 112 of the housing 14.

The u-shaped insulators 128, 110 and conductive strips 130, 112 are secured using small screws 132 which are separated from the conductive strips 130, 112 via insulated barrel nuts 134 and washers 136.

A screw switch 138 is threaded within a female threaded opening 140 of the conductive strip 112 and insulated from the housing 14 using an insulated bushing 137, depicted in FIG. 11. When the screw switch 138 is fully inserted, it contacts the mischmetal flint rod 32, thus providing electrons through the conductive strip 112, the conductive insert 102 and then the conductive strip 130 of the power generating handle 12.

One feature of the present invention is that a long electrical life is presented to illuminate the LED 50. The surface of the mischmetal flint rod 32 oxidizes over time, thereby reducing its electron generating potential. However, by simply striking the mischmetal flint rod 32 to cause sparks, the oxidized layer is removed thus presenting a clean surface for electron generation.

When the screw switch is not fully threaded, the mischmetal flint rod does not have the electronic conduit necessary to power the LED or incandescent lamp and hence the LED is not illuminated.

Turning to FIG. 13, within the LED mount 42, a set screw 144 both contacts and holds the positive LED terminal 94 in place and protrudes enough to electronically couple to the copper member 24. A second set screw 146 electronically couples the conductive strip 130 of the power generating handle 12 to the negative LED terminal 96 of the LED 50. The second set screw 146 also mechanically restrains the negative LED terminal 96 from extending radially outward.

Figure 9:
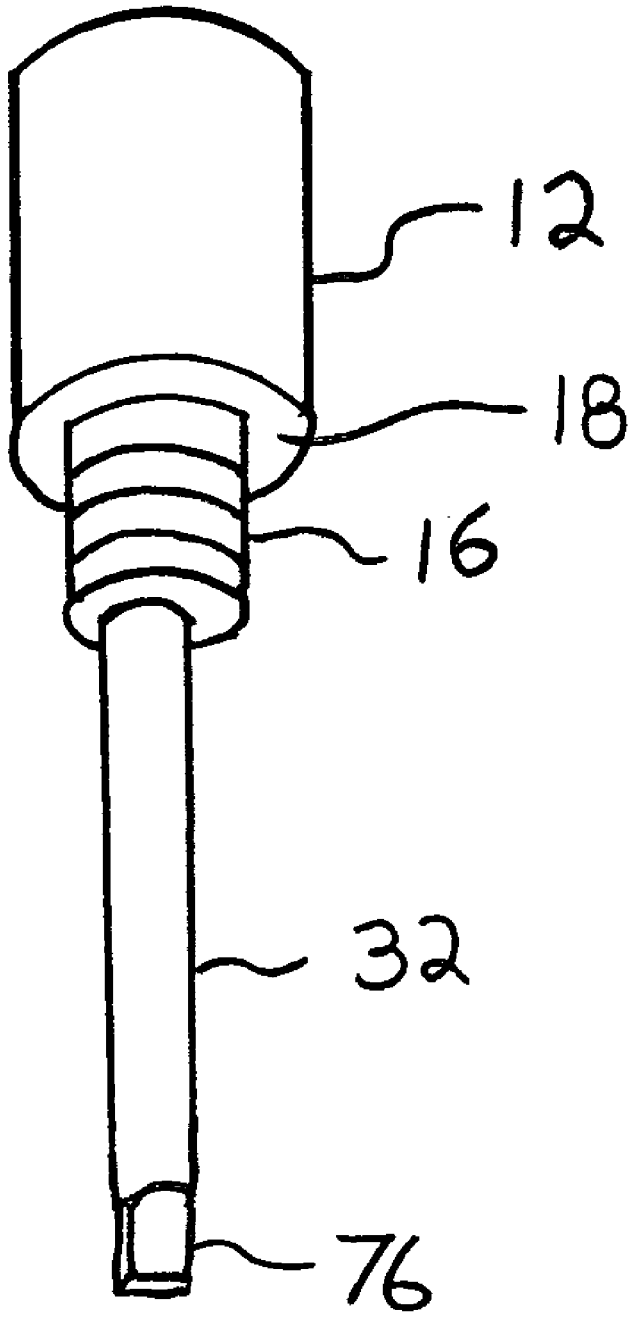
FIG. 9 is a side elevation view of the power generation handle of FIG. 2 depicting a tool at a tip end of a mischmetal rod.

Turning now to FIG. 9, the protruding mischmetal flint rod 32 may include either a screw end 76 or knife end which are also useful tools for the outdoor enthusiast. The screw end 76 may be useful for various obvious tasks while the knife end (not depicted) may be useful for other tasks such as gutting or cleaning fish.

Figure 10:
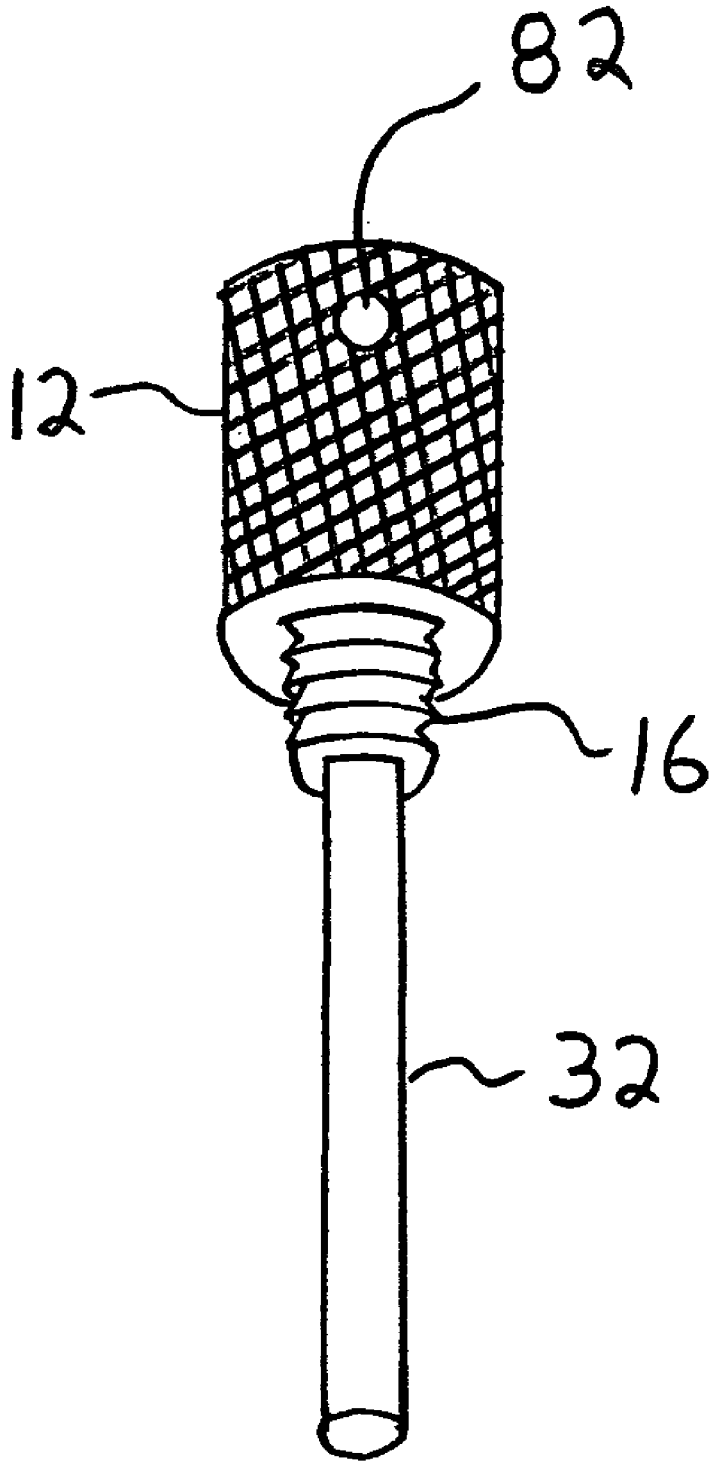
FIG. 10 is a side elevation view of the power generation handle of FIG. 2 depicting a grooved exterior surface.

Turning now to FIG. 10, a small tie opening 82 is bored radially through the handle 12 to provide a means to tie a small string or key ring through for carrying the power generation spark emitting device 10 of the present invention. Additionally, the outer surface of the power generation handle 12 may be grooved to provide an improved gripping surface.

Various changes and modifications, other than those described above in the preferred embodiment of the invention described herein will be apparent to those skilled in the art. While the invention has been described with respect to certain preferred embodiments and exemplifications, it is not intended to limit the scope of the invention thereby, but solely by the claims appended hereto.

What is claimed is:

1. An electrical power generating and spark emitting device comprising:

a handle that is manufactured from at least one material, and wherein at least a portion of said handle is manufactured from a first material that has a first fixed standard reduction potential;

a flint rod that axially extends from said handle said flint rod having an extended portion that does not make physical contact with said handle, and wherein said flint rod is manufactured from a second material that has a second fixed standard reduction potential which is different than said first fixed standard reduction potential; a strike plate wherein when striking the flint rod against the strike plate creates sparks; and an electrolyte disposed within said handle and between said handle and said flint rod, said electrolyte functions at least in part, to provide an electrical connection between said flint rod and said first material of said handle and wherein said electrolyte facilitates transfer of electrons between said flint rod and said handle.

2. The apparatus of claim 1, further including having a first terminal electronically coupled to said flint rod and a second terminal electronically coupled to said at least a portion of said handle.

3. The apparatus of claim 2, further including an illumination member electronically connected between said first and second terminals.

4. The apparatus of claim 1, further including a housing having an internal cavity, and wherein said housing mates with said handle such that said protruding portion of said flint rod is disposed within said internal cavity of said housing.

5. The apparatus of claim 4, wherein said housing further includes a recessed strike plate affixed thereto.

6. The apparatus of claim 5, further including a recessed guide that is angled with respect to said strike plate, and wherein said recessed guide further includes opposing sidewalls sufficiently spaced to guide axial movement of a substantial portion of said flint rod in frictional contact with said strike plate.

7. The apparatus of claim 1, wherein said flint rod is comprised of at least one element selected from the group consisting essentially of iron, magnesium, cerium, lanthanum, neodymium and praseodymum.

8. The apparatus of claim 1, further including a storage housing which mates with said handle for storing extraneous equipment.

9. The apparatus of claim 4, further including a storage housing which mates with a closed end of said housing for storing extraneous equipment.

10. The apparatus of claim 1, wherein said protruding portion of said flint rod further includes a tool end.

11. The apparatus of claim 2, further including switching means electronically couple between said first and second terminals.

12. An electrical power generating and spark emitting device comprising:

a handle;

a charged member disposed within said handle and having a charged fixed standard reduction potential;

a flint rod that extends from said handle, said handle having an extended portion that does not make physical contact with said charged member and wherein said flint rod has a first fixed standard reduction potential which is different than said charged fixed standard reduction potential;

a strike plate wherein striking the flint rod against said strike plate creates sparks; and an electrolyte disposed within said handle and between said charged member and said flint rod which provides at least in part, an electrical connection between said flint rod and said charged member and wherein said electrolyte facilitates transfer of electrons between said flint rod and said charged member.

13. The apparatus of claim 12, further including an illumination device cavity having a first terminal electronically coupled to said flint rod and a second terminal electronically coupled to said at least a portion of said handle, and an illumination member electronically couple across said first and second terminals.

14. The apparatus of claim 12, further including a housing having an internal cavity, wherein said housing mates with said handle such that said protruding portion of said flint rod is disposed within said internal cavity of said housing.

15. The apparatus of claim 14, wherein said housing further includes a strike plate affixed thereto.

16. The apparatus of claim 12, wherein said flint rod is comprised of at least one element selected from the group consisting essentially of iron, magnesium, cerium, lanthanum, neodymium and praseodymum.

17. The apparatus of claim 12, further including a storage housing which mates with said handle for storing extraneous equipment.

18. The apparatus of claim 12, wherein said protruding portion of said flint rod further includes a tool end.

19. The apparatus of claim 13, further including switching means electronically coupled between said first and second terminals.

20. A spark emitting device comprising:

a handle;

a flint rod that is fixedly attached to and that axially extends from said handle;

a detachable housing that mates with said handle to form a one piece device; and wherein said housing further includes a detachable strike plate and a recessed guide located along an external surface of said housing, and wherein said recessed guide further includes opposing sidewalls sufficiently spaced apart to facilitate placement and axial movement of said flint rod in physical contact with an edge of said strike plate, said edge being recessed between said opposing sidewalls for generation of one or more sparks.

21. The device of claim 20, wherein said recessed guide is angled relative to said strike plate.

22. The device of claim 20, wherein said strike plate is composed of a rectangular shaped piece of metallic material.

23. The device of claim 20, wherein said strike plate is detachable and repositionable via an attachment screw.

24. The device of claim 20, wherein said axial movement of said flint rod is facilitated over substantially an entire length of said flint rod.

25. The device of claim 20, wherein said recessed guide is configured to facilitate said axial movement of said flint rod at about a 45 degree angle relative to said strike plate.

26. The device of claim 20, wherein said recessed guide is angled at about a 45 degree angle relative to said strike plate.

27. The device of claim 20, wherein said strike plate is detachable via unscrewing of an attachment screw.

28. The device of claim 20, wherein said strike plate is a metallic strike plate.

* * * * *